US006422519B1

(12) United States Patent
Braatz

(10) Patent No.: US 6,422,519 B1
(45) Date of Patent: Jul. 23, 2002

(54) RAILROAD TRACK SWITCH OPERATOR

(75) Inventor: James D. Braatz, Greenfield, WI (US)

(73) Assignee: AAA Sales & Engineering, Inc., Oak Creek, WI (US)

( * ) Notice: Subject to any disclaimer, the term of this patent is extended or adjusted under 35 U.S.C. 154(b) by 0 days.

(21) Appl. No.: 09/653,711

(22) Filed: Sep. 1, 2000

(51) Int. Cl.[7] ..... B61L 11/06; B61L 7/04
(52) U.S. Cl. ..... 246/258; 246/415 R; 246/393
(58) Field of Search ..... 246/257, 415 R, 246/393, 242 R, 258, 411

(56) References Cited

U.S. PATENT DOCUMENTS 3,708,660 A * 1/1973 Speight ..... 246/393

* cited by examiner

*Primary Examiner*—S. Joseph Morano
*Assistant Examiner*—Robert J. McCarry, Jr.
(74) *Attorney, Agent, or Firm*—Andrus, Sceales, Starke & Sawall

(57) ABSTRACT

An improved cylinder head for a railroad track switch operator includes totally self-contained electronics and pneumatics for easy and direct replacement of a cylinder head on a prior art switch operator. The improved cylinder head has enhanced porting to improve air flow and speed of operation, a voltage control module permitting the unit to operate with either 24 volt or 12 volt line power, and recessed portions for covering or enclosing delicate and/or sensitive components for maximized protection in harsh outdoor installations.

11 Claims, 8 Drawing Sheets

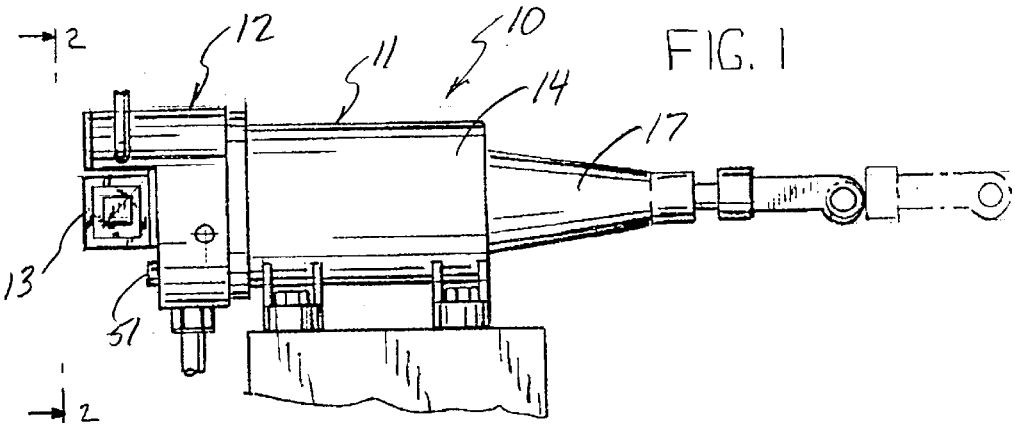
FIG. 1
FIG. 2
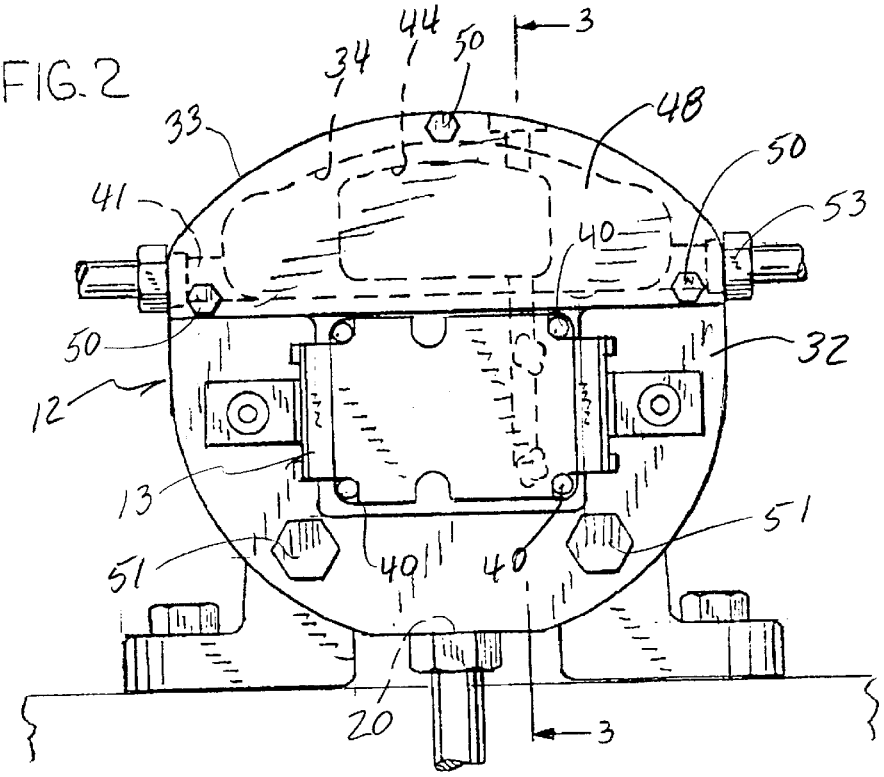

FIG. 5
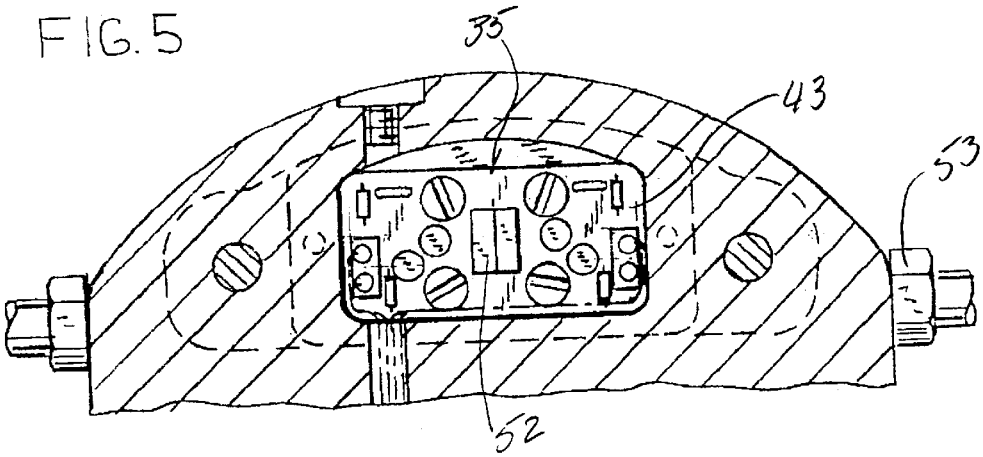
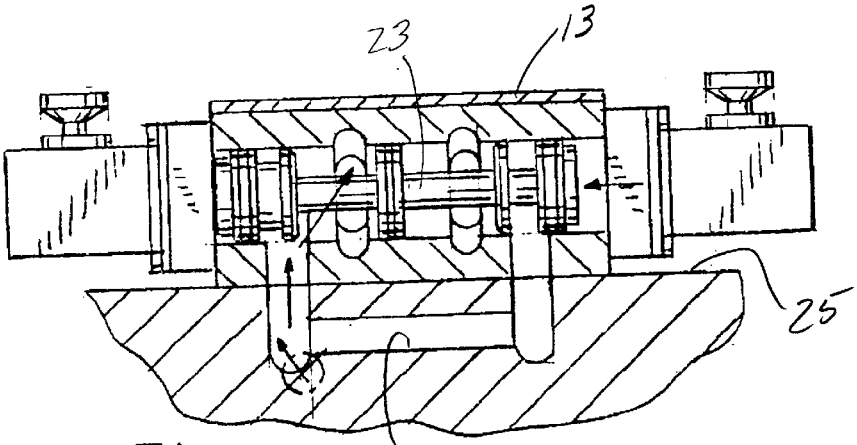
FIG. 7A
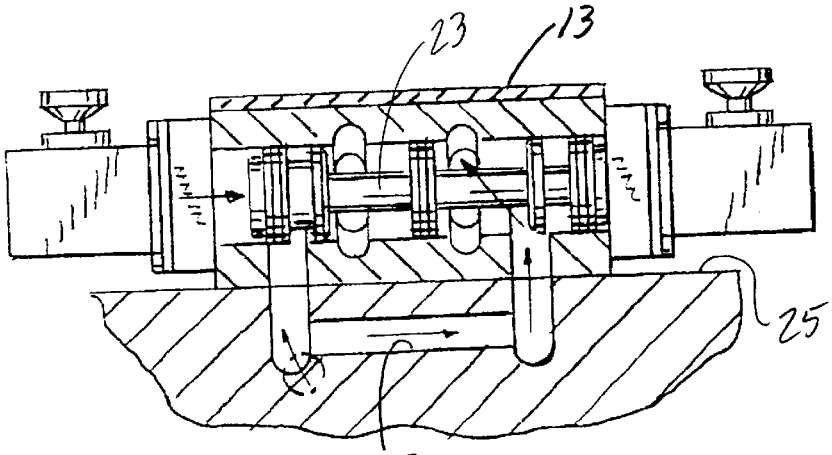
FIG. 7B

FIG. 6
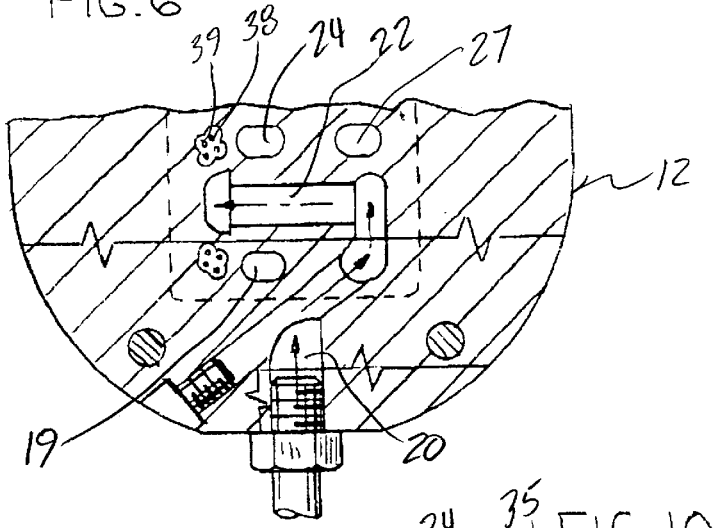
FIG. 8
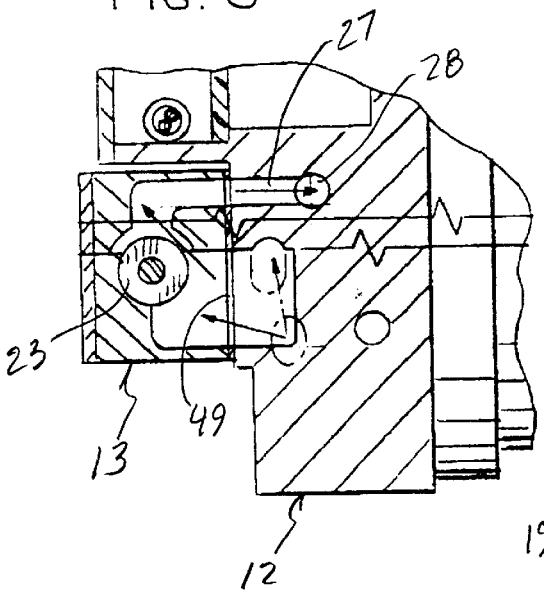
FIG. 10
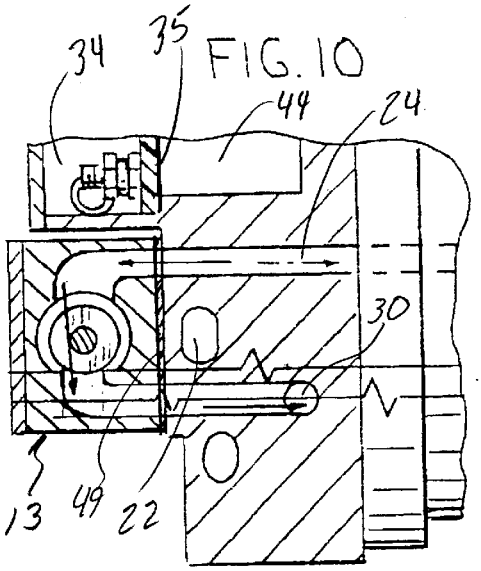
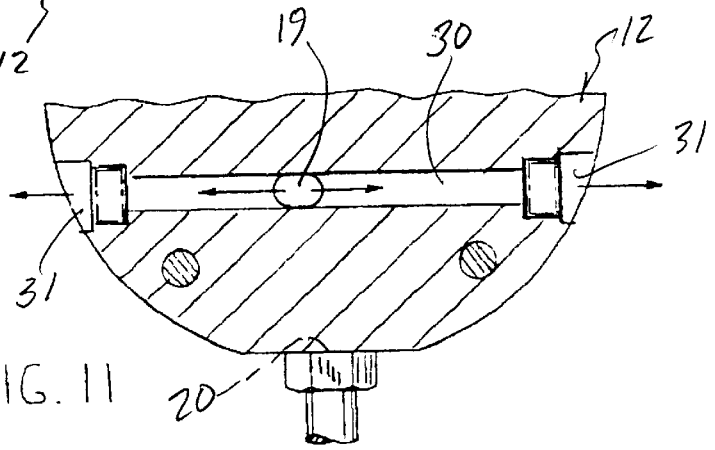
FIG. 11

RAILROAD TRACK SWITCH OPERATOR

BACKGROUND OF THE INVENTION

The present invention pertains to an operator for a railroad track switch and, more particularly, to an improved cylinder head assembly for a pneumatically driven operator.

Railroad track switch operators or switch machines of the prior art are powered by a number of different types of actuators. Pneumatic cylinders and hydraulic cylinders are commonly used with the piston rods of such cylinders operatively connected to the switch points to selectively move the points between the two positions. Electric motor and fluid motor-driven actuators are also used. In addition, many switch operators also provide the capability for alternate manual operation.

In a railroad yard, a large number of switch points may be used and they are typically connected to a central monitoring and control system for automatic or semi-automatic operation. The operation of multiple switch points also typically includes a common electric power supply for operating valves and a common pressurized fluid supply for pneumatic or hydraulic cylinder operators. Thus, pneumatic switch operators are connected to a common source of compressed air and the operating valves used to control the pneumatic cylinders receive electric power from a common electric power supply line. In the United States, the railroad industry has adopted both 12 volt and 24 volt DC as standard switch operator power supplies.

The use of two different operating voltage standards has resulted in difficulties in operator repair and replacement and has also resulted in operational difficulties within a given system. Twelve volt operators may operate adequately over a voltage range between about 9 and 14 volts, whereas 24 volt operators may operate adequately over a range of about 19 volts to 26 volts. However, neither type of operator will operate in the voltage range needed to power the other type of operator and, furthermore, there is a dead band of about 4 to 6 volts between the respective ranges where neither operator will work. In addition, typical line voltage drops in large 24 volt systems often result in voltage variations that adversely affect operation or drop so low as to prevent operation.

Prior art pneumatic operators, though made to effect a point switch in about 0.5 second, would benefit from faster operation, particularly where the operator is subject to voltage variations due to line voltage losses and the like. Tracks switch operators of the prior art have also been characteristically difficult to service and repair. Electric power for the operating valve and compressed air to supply the motive force for the cylinder are typically supplied directly to the cylinder head. Removal and replacement of the valve typically requires manual disconnection of a number of electric leads and the removal of mounting bolts for the valve, all in a time consuming and inefficient manner. These maintenance and service problems are compounded when they must be performed in cold or other inclement weather.

SUMMARY OF THE INVENTION

In accordance with the present invention, an improved cylinder head assembly is provided for a pneumatic railroad track switch operator that addresses and eliminates or substantially improves all of the problems in prior art operators. The typical prior art pneumatic track switch operator includes a solenoid-operated spool valve that directs compressed air from a source to the piston of a double acting pneumatic cylinder. A prior art cylinder head may include a mounting surface for the spool valve and is further provided with internal air flow porting to control the flow of compressed air and exhaust air to and from the cylinder. Such porting typically includes a compressed air inlet port, a first supply passage that directs compressed air to one side of the piston to stroke the piston in a first direction and receives exhaust air from the same side of the piston when the piston is stroked in the opposite direction, a second supply passage that directs compressed air to the other side of the piston to stroke the piston in the opposite direction and receives exhaust air from that other side of the piston when the piston is stroked in the first direction, a first exhaust port that receives air from the first supply passage and a second exhaust port that receives air from the second supply passage. In accordance with the present invention, the improved cylinder head assembly comprises means for interconnecting the first and second exhaust ports to permit the flow of exhaust air from either of said supply ports to pass through both of the exhaust ports; recessed portions in the cylinder head for receiving electric power connections for operating the spool valve; voltage control means for applying 12 volt electric operating power to the spool valve from line voltage in excess of about 14 volts and for passing line voltage between about 14 volts and a minimum operating voltage directly to the spool valve; the voltage control means comprising a control module that is received in one of the recessed portions in the cylinder head; and interface means in another of the recessed portions of the cylinder head that defines the valve mounting surface for receiving the spool valve and provides direct connection to the ports and plug-in electric power connection to the voltage control module.

The voltage control module is preferably operative over a voltage range of from about 26 volts to about 9 volts. The module includes means for converting line voltage in the range of about 26 volts to about 14 volts to an operating voltage of about 12 volts. The module also includes means for passing line voltage in the range of about 14 volts to about 9 volts directly to the valve.

In the improved cylinder head assembly of the present invention, the interface means includes a first internal passage extending between said recesses and an operating power electrical conductor in the passage connecting the voltage control module and the plug-in connection. The cylinder head also includes a second internal passage and a line voltage power conductor within the second passage providing electric power at line voltage to the control module.

BRIEF DESCRIPTION OF THE DRAWINGS

FIG. 1 is a side elevation view of a prior art pneumatic cylinder for a railroad track switch operator on which is mounted the improved cylinder head assembly of the present invention.

FIG. 2 is an enlarged end elevation taken on line 2—2 of FIG. 1.

FIG. 5 is a sectional detail taken on line 5—5 of FIG. 3.

FIG. 6 is a sectional detail taken on line 6—6 of FIG. 3.

FIGS. 7A and 7B are horizontal sectional details taken on line 7A,7B-7A,7B of FIG. 4 showing the control valve in each of its two operational positions.

FIG. 8 is a vertical sectional detail taken on line 8—8 of FIG. 4.

FIG. 10 is a vertical sectional detail taken on line 10—10 of FIG. 4.

FIG. 11 is a vertical sectional detail taken on line 11—11 of FIG. 3.

DETAILED DESCRIPTION OF THE PREFERRED EMBODIMENT

Figure 9A:
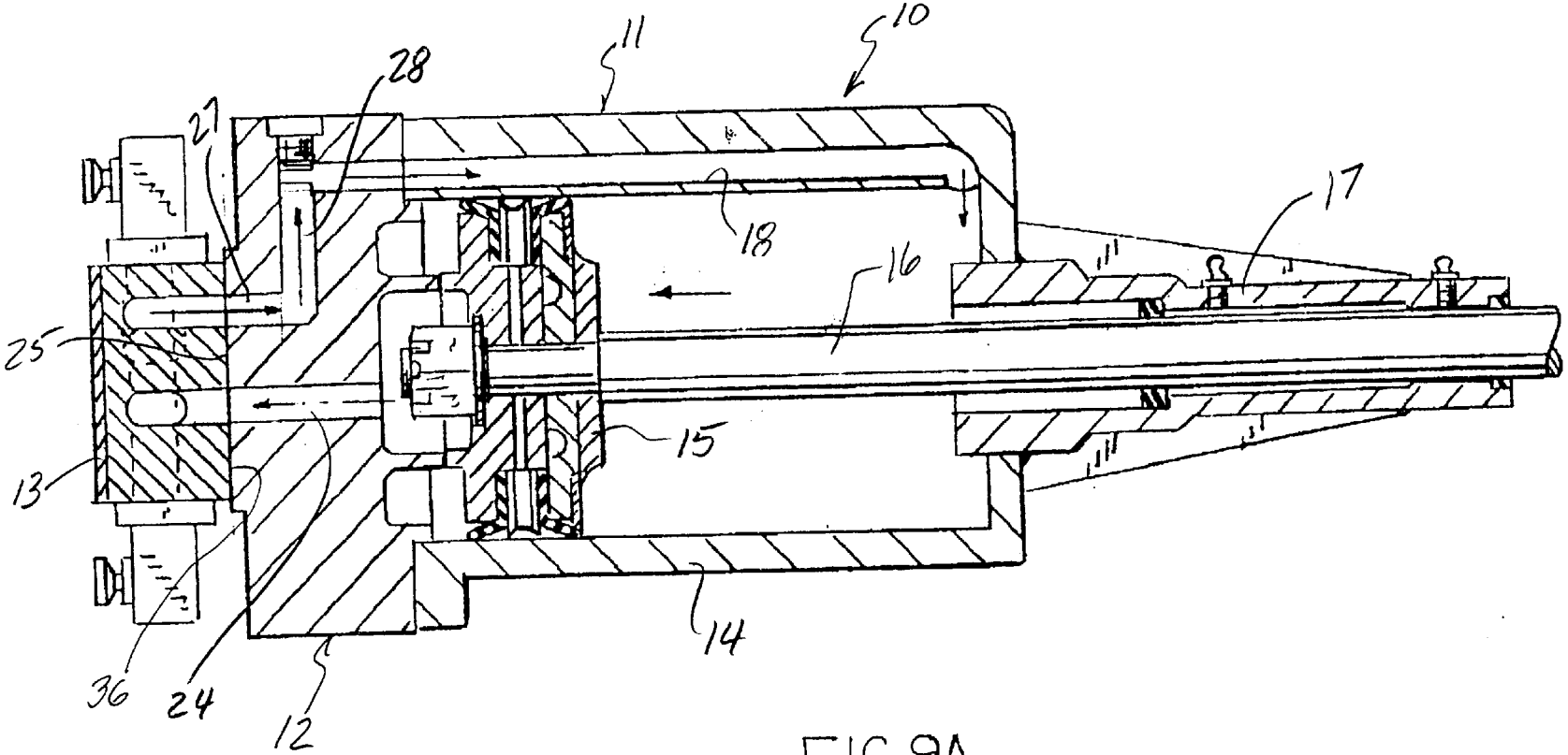
FIGS. 9A and 9B are horizontal sectional views through the entire switch operator showing generally schematically the air flow in the operator corresponding to the valve positions of FIGS. 7A and 7B, respectively.
Figure 9B:
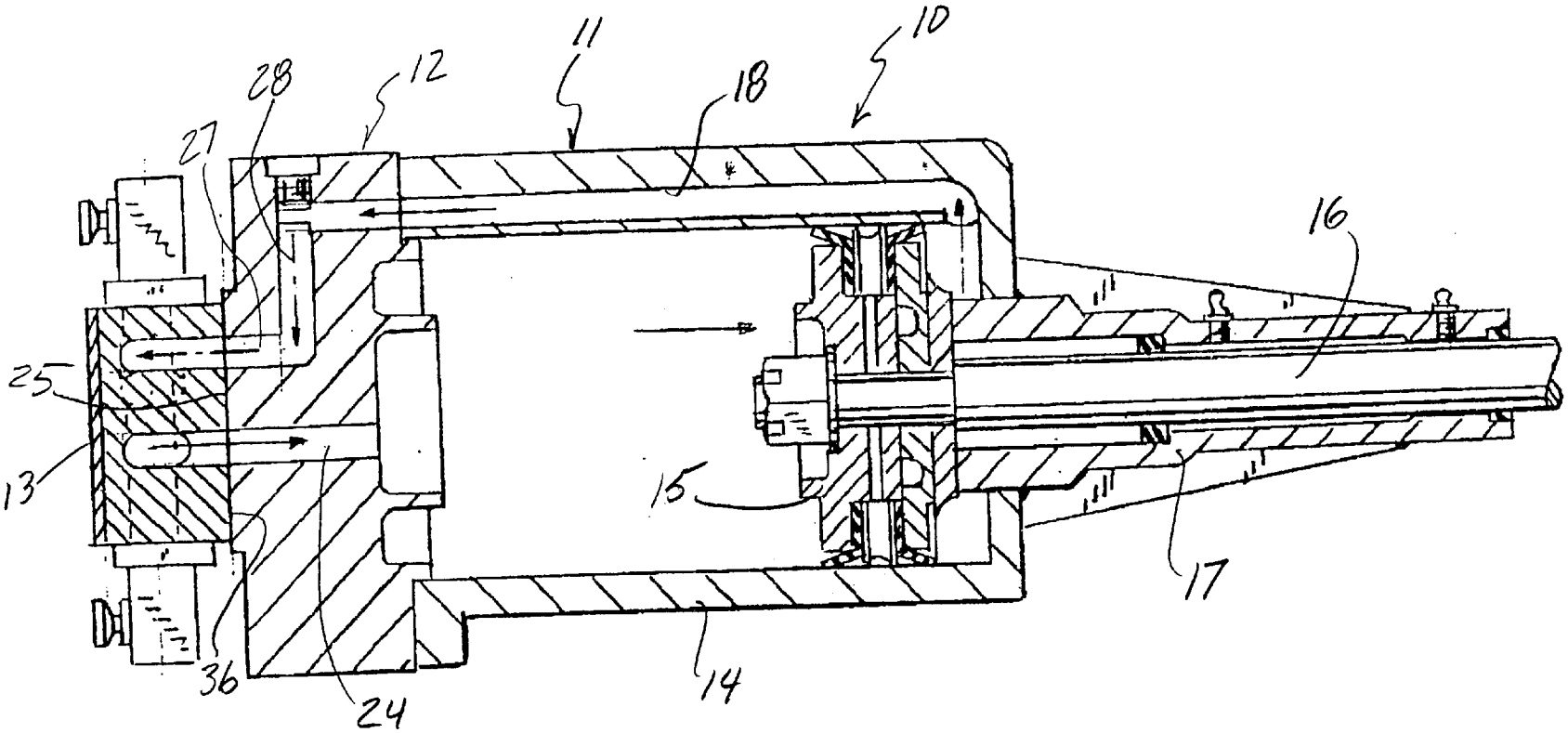

FIG. 1 shows the general arrangement and FIGS. 9A and 9B , somewhat schematically, a track switch operator 10 utilizing a pneumatic cylinder 11 of a prior art construction and an improved cylinder head 12 of the present invention utilizing a commercially available 4-way solenoid pilot operated control valve 13. The valve 13 may be a 6600 Series valve manufactured by Mac Valves, Inc. of Wixom, Mich. The prior art cylinder 11 includes a cylinder body 14 which defines the internal cylinder wall for a piston 15 and attached piston rod 16. The cylinder head 12 is attached to the piston end of the cylinder body 14 and the rod 16 extends through the opposite end of the cylinder body where it is supported along a portion of its length by an integral extension sleeve 17. The sleeve 17 carries conventional seals and provides a grease reservoir for lubrication of the piston rod 16. The free end of the piston rod is connected to the track switch points in a conventional manner such that reciprocating movement of the piston and attached piston rod will move the switch points from one position to another, all in a manner well known in the art.

In FIGS. 1 and 9A, the piston 15 is shown in its fully retracted position within the cylinder body 14. Compressed air admitted to the piston end of the cylinder (immediately adjacent the cylinder head 12) will move the piston to extend the piston rod 16 to the phantom line position of FIG. 1 and the position of FIG. 9B. Simultaneously, air within the cylinder body 14 on the opposite rod end of the piston will pass into the open end of an exhaust channel 18 from which it passes in a reverse direction axially along the cylinder body 14 and into the cylinder head 12 from which it is exhausted, after passage through related control porting in the valve 13, as will be described in greater detail below.

In a railroad switching yard, operation of each of the many switch points is handled by an operator 10 of this type. A central source of compressed air supplies operating air pressure to each cylinder 11. Direct current power to operate the control valve 13 is supplied from a common electric power source, typically supplying power at a nominal line voltage of either 12 volts or 24 volts. All of the switches in a rail yard are monitored from a central control tower or station to determine position, and are controlled by generating a signal from the tower to change the switch position as needed.

Referring also to FIGS. 2–4 and 6, compressed air from a common supply line enters the cylinder head 12 via an air inlet port 20 in the bottom face of the cylinder head. It should be noted that normal orientation of a switch operator 10 is horizontal so that the piston rod 16 reciprocates along a horizontal axis. Thus, the position of the air inlet port 20 is typically on the bottom of the operator as it is installed. From the air inlet port 20, compressed air flows along an air inlet passage 21 that includes an internal leg 22 providing a common supply of compressed air to both sides of the control valve 13 which directs it back through the cylinder head and to one side or the other of the piston 15, depending upon the position of the valve spool 23. In FIG. 7B, the valve spool 23 has been shifted to the right to direct incoming compressed air into a first supply passage 24 in the cylinder head 12 (which in industry terminology is commonly referred to as the "reverse supply port"). As is well understood in the operation of double acting cylinders, the first supply passage 24 will receive exhaust air from the cylinder when the cylinder is operated in the opposite direction, as will be discussed. Referring also to FIGS. 9B and 12, the first supply port 24 extends horizontally through the cylinder head 12 between a valve mounting face 25 on the outside of the cylinder head and a cylinder mounting face 26 on the inside of the cylinder head where it has open communication with the head end of the piston 15. A second supply passage 27 extends through the cylinder head between the valve mounting face 25 and the cylinder mounting face 26 where it opens into communication with the exhaust channel 18. The second supply passage 27 includes an internal offset leg 28 (FIGS. 4 and 8) to provide air flow to the radial outer edge of the cylinder body 14 in which the exhaust channel 18 is located. With the valve spool 23 in the right hand position of FIG. 7B, flow from the air inlet passage 21 into the second supply passage 27 is blocked. However, in the right hand position of the valve, communication between the second supply passage 27 and an exhaust passage 30 is open as shown in FIG. 12B. In the right hand position, exhaust flow from passage 27 passes into the control valve chamber and exits into an exhaust inlet 19 in the mounting face 25 of the cylinder head. The exhaust inlet 19 connects directly with exhaust passage 30. The exhaust passage 30 extends horizontally between opposite sides of the cylinder head and interconnects diametrically opposite exhaust ports 31 through which air is exhausted to atmosphere. In FIG. 12B, arrows 29C show the direction of flow of the supply of compressed air and arrows 29E show the direction of exhaust flow.

Figure 12A:
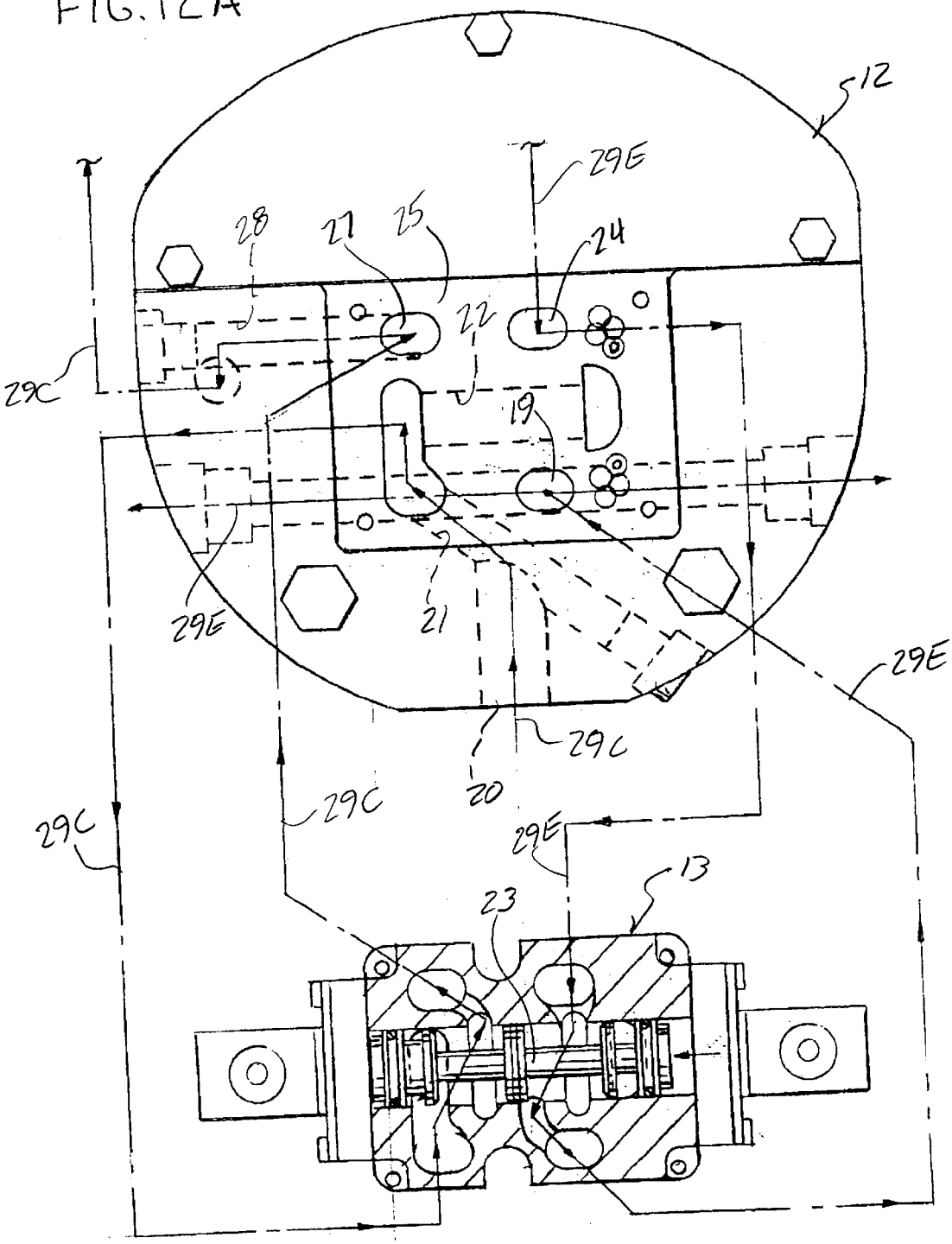
FIGS. 12A and 12B are end elevation views of the cylinder head and control valve (separated for clarity) showing the interrelationship between the air flow porting and the direction of air flow corresponding to the control valve and cylinder positions of FIGS. 7A, 9A and 7B, 9B, respectively.
Figure 12B:
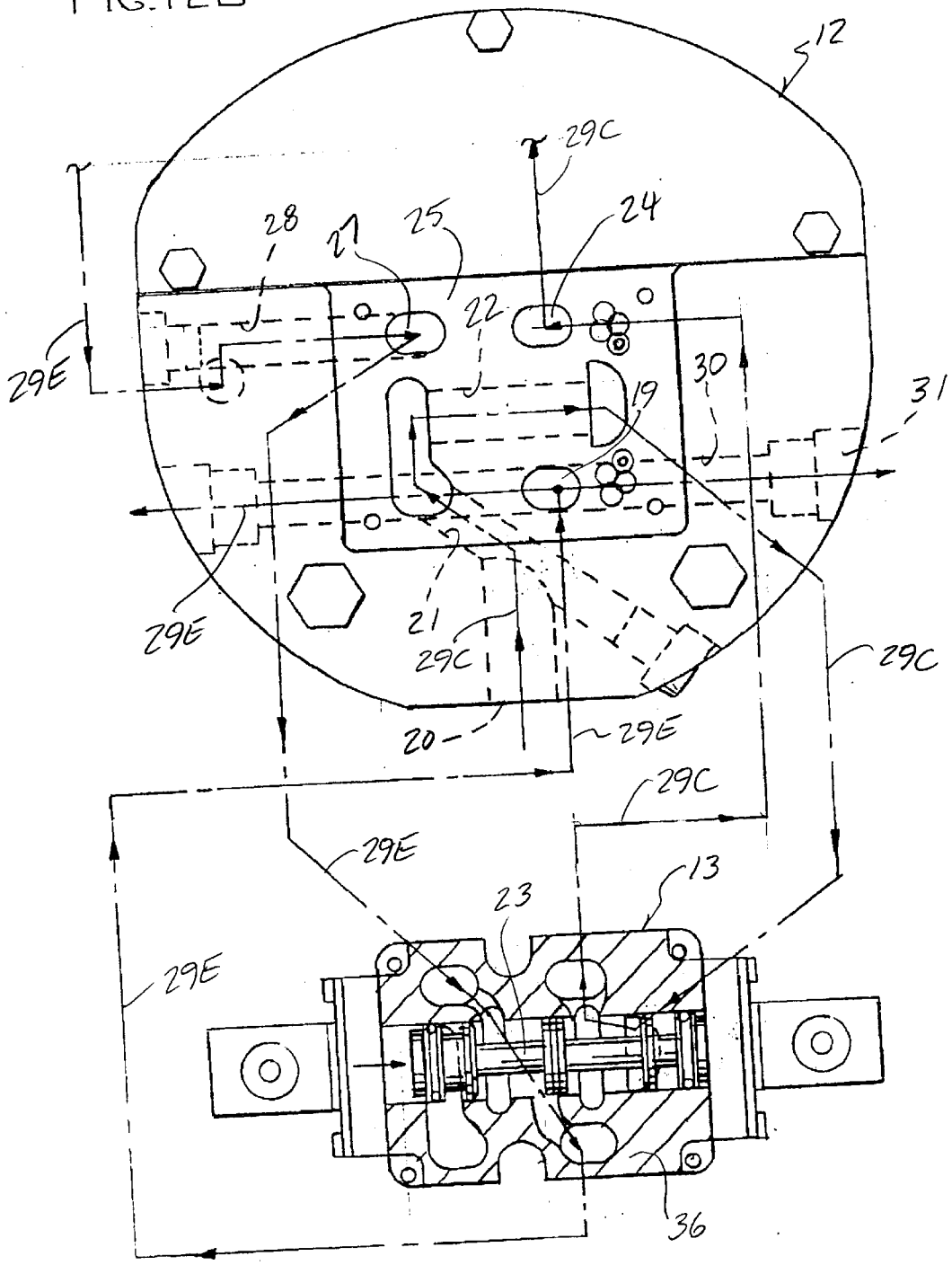

In FIGS. 7A and 12A, the valve spool 23 is shifted to the left hand position whereby flow through the operator 10 is reversed. In this position, compressed air flows to the rod end of the cylinder via the second supply passage 27 while exhaust from the piston end of the cylinder flows out through the first supply passage 24. The arrows 29C in FIG. 12A show the direction of compressed air flow and the arrows 29E show the direction of exhaust air flow.

A significant feature of the improved cylinder head 12 of the present invention is the single common air inlet passage 21 which serves to supply compressed air to both the first and second supply passages 24 and 27 (depending on valve position), and the common exhaust passage 30, which receives exhaust air which permits the flow of exhaust air through both exhaust ports 31. The combination of these common inlet and exhaust passages increases the volumetric flow through the cylinder in cylinder operation in either direction. The result is increased operating speed in both directions. In particular, the common connection of the exhaust ports 31 eliminates a major exhaust flow restriction. The stroke time of the cylinder may, for example, be reduced by one-third or more from 450 ms to 300 ms.

Referring particularly to FIGS. 1–5, the improved cylinder head 12 of the present invention also includes features which substantially enhance assembly and serviceability, increase reliability and durability, and further enhance performance. The cylinder head 12 is preferably made from an iron casting which includes a main body 32 that contains the air flow passages and porting previously described, and a raised semi-circular segment 33 that defines a large internal recess 34 for receipt of a voltage control module 35. Just below the raised segment 33 there is located the valve mounting face 25 in which is located the air flow porting described above and which is adapted to mate with and provide an interface with a mounting surface 36 on the control valve 13. Because the valve mounting face 25 is recessed from the outer edge of the raised segment 33, the flat lower wall 37 of the raised segment provides a protective wall for the control valve 13 when it is mounted to the cylinder head. In the normal horizontal orientation in which the switch operator is mounted, the protective side wall 37 overlies a substantial portion of the valve. This is important because, in the rugged environment in which these switch operators are installed and operate, they are typically stepped on and subjected to other rough treatment.

Figure 3:
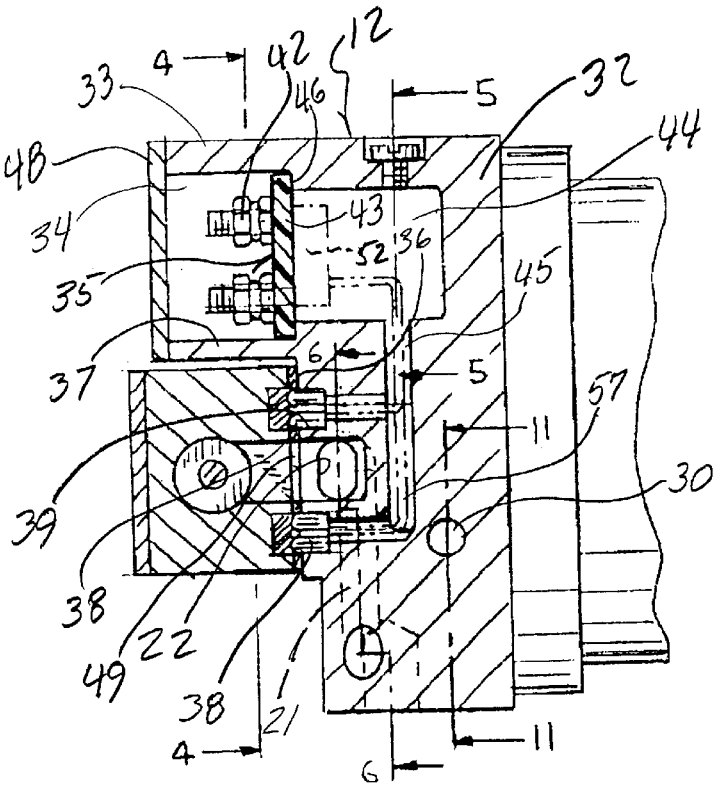
FIG. 3 is a vertical section through the cylinder head and associated valve taken on line 3—3 of FIG. 2.
Figure 4:
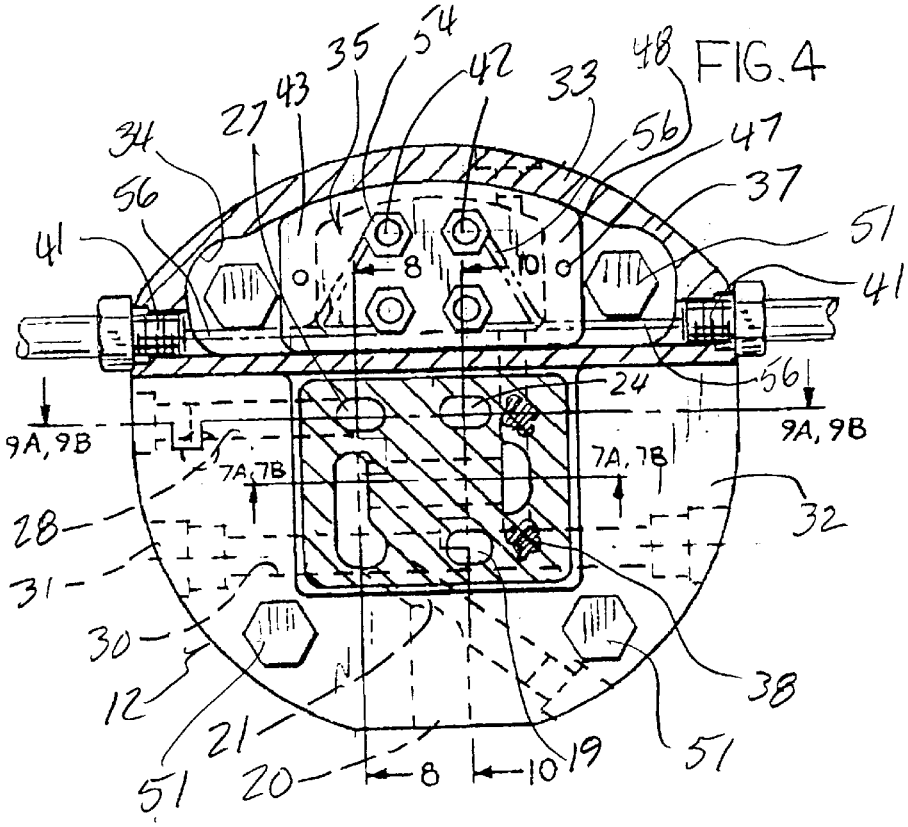
FIG. 4 is a vertical section taken on line 4—4 of FIG. 3.

As may be seen in FIGS. 3, 4 and 6, in the valve mounting face 25 of the cylinder head, there are a pair of recessed bores 39 for plug-in connectors 38. The connectors 38 are aligned with mating connectors recessed in the mounting surface 36 of the control valve such that, when the control valve is bolted to the valve mounting face 25, electrical connections are automatically established. Thus, after interposing a suitable gasket 49 between the valve mounting face 25 on the cylinder head and the mounting surface 36 on the valve, complete pneumatic and electrical connections may be established with four mounting bolts 40.

As best shown in FIGS. 3, 4 and 5, DC operating power at supply line voltage is brought into the recess 34 in the raised segment 33 of the cylinder head through one or both of a pair of line openings 41 on opposite sides of the wall defining the recess 34. Appropriate connections between the supply line or lines 56 is made first to the voltage control module 30 at the terminals 42 provided thereon. The control module itself includes a circuit board 43 which carries the electrical components on the face opposite the terminals 42. The circuit components 55 extend into a secondary recess 44 at the bottom of recess 34 formed by the semi-circular raised segment 33. Electrical leads 57 from the control module circuit board 43 to the control valve 13 extend through an internal passage 45 extending from the secondary recess 44 to the lower ends of the bores 39 containing the plug-in connectors 38. The control module circuit board 43 rests on a shoulder 46 defined by the transition between the bottom of the recess 34 and secondary recess 44. The circuit board 43 may be conveniently held in place with a pair of mounting screws 47. The leads from the plug-in connectors 38 which pass through the internal passage 45 and into the secondary recess 44 are preferably connected to the control module circuit board 43 with removable plugs that are contained in the secondary recess and is easily accessible for connection or disconnection when the control module circuit board is removed from its mounting. The entire recess 34 is conveniently closed by a removable, weather tight cover 48 held in place with a number of machine screws 50.

The function of the voltage control module 35 will now be briefly described. As indicated in the background portion of the specification above, tracks switch operators in the U.S. typically operate with 24 volt DC or 12 volt DC power. This, of course, makes compatibility of an operator designed to run at one voltage difficult or impossible for use in a system operating at the other voltage. Another and possibly more serious problem, however, is that in 24 volt systems, it is not uncommon for the line voltage to drop below the effective operating voltage because of line losses that inevitably occur over a long and extended supply system. Typically, if line voltage drops below about 18–19 volts, a 24 volt operator will cease to function. In addition, standard 12 volt systems are typically designed to operate at a maximum voltage of about 13–14 volts. Thus, there is a dead band of about 5 volts between the minimum effective operating voltage for a 24 volt system and the maximum operating voltage for a 12 volt system.

The solenoid operated control valve 13 operates at a nominal 12 volts DC and the voltage control module 35 permits the control valve to function with incoming line voltages that range from a maximum typically encountered in a 24 volt system (i.e. about 26 volts) to the minimum effective operating voltage for the valve (i.e. about 9 volts). Thus, the circuit board 43 for the voltage control module utilizes conventional solid state components including a voltage regulator 52 that, in one mode of operation, steps down any incoming line voltage above about 14 volts to 12 volts and, in a second mode of operation, permits line voltage from about 14 volts down to the minimum operating voltage for the valve to pass through directly to the valve. Preferably, the voltage control module circuit also includes a diode arrangement that makes the circuit polarity insensitive to protect the circuit from inadvertent application of voltage at the wrong polarity. The circuit is also preferably provided with automatically resettable fuses, thereby precluding the need for manual resetting.

The cylinder head 12 is designed for direct retrofit replacement on existing switch machines. The improved cylinder head 12 is attached to the cylinder body with bolted connections 51 that pass through the cylinder head and thread into suitably tapped holes in the cylinder body 14. As previously indicated, the improved cylinder head of the present invention is adaptable to retrofit applications to either 24 volt or 12 volt switch machines. Assembly, servicing and maintenance of the cylinder head are straightforward and simple. The control valve 13 may be removed for service or replacement with four mounting bolts 40. The plug-in electrical connectors 38 preclude the need to make manual terminal disconnections. To remove the entire cylinder head 12, the electric power supply lines 56 are disconnected from the terminals 42 (after removing the access cover 48) and the four bolted connections 51 are removed. If necessary, the voltage control module 35 may be removed from the secondary recess 44 by removing two mounting screws 47 and unplugging the connection through the internal passage 45 to the control valve 13.

Additional features which enhance serviceability and operability of the improved cylinder head 12 of the present invention include the use of easily removable threaded plugs 53 for one or the other of the electric supply line openings 41, and the use of machine screws 50 for the cover 48 that have heads sized to match the terminal nuts 54 on the voltage control module 35. The latter feature facilitates terminal connection tasks by eliminating the use of another tool. Finally, apart from the entry of the line voltage conductors through the line openings 41 and into the recess 33, all other electrical conductors and connections are housed within the cylinder head, completely protected and easily connected or disconnected with plug-in connectors.

I claim:

1. In a pneumatic operator for a railroad track switch including a solenoid-operated spool valve for directing compressed air from a source to the piston of a double acting pneumatic cylinder, a cylinder head assembly providing a mounting surface for the spool valve, and air flow porting between the spool valve and the cylinder, said porting including a compressed air inlet passage, a first supply passage directing compressed air to one side of the piston to stroke the piston in a first direction and receiving exhaust air from said one side of the piston when the piston is stroked in the opposite second direction, a second supply passage directing compressed air to the other side of the piston to stroke the piston in said second direction and receiving exhaust air from said other side of the piston when the piston is stroked in said first direction, a first exhaust port receiving air from said first supply passage and a second exhaust port receiving air from said second supply passage, an improved cylinder head assembly comprising:

an exhaust passage interconnecting said first and second exhaust ports to permit the flow of exhaust air from either of said supply passages to pass through both of said exhaust ports;

recessed portions in the cylinder head for receipt of electric power connections for operating the spool valve;

voltage control means for applying nominal 12 volt electric operating power to the spool valve from line voltage in excess of about 14 volts and for passing line voltage between about 14 volts and a minimum operating voltage directly to the spool valve;

said voltage control means comprising a control module received in one of said recessed portions; and, interface means in another of said recessed portions defining the valve mounting surface for receipt of the spool valve and providing direct connection to said ports and plug-in electric power connection to said voltage control module.

2. The invention as set forth in claim 1 wherein said voltage control module is operative over a voltage range of from about 26 volts to about 9 volts.

3. The invention as set forth in claim 2 wherein said voltage control module includes means for converting line voltage in the range of about 26 volts to about 14 volts to an operating voltage of about 12 volts.

4. The invention as set forth in claim 2 wherein said voltage control module includes means for passing line voltage in the range of about 14 volts to about 9 volts directly to the valve.

5. The invention as set forth in claim 1 wherein said interface means includes an internal passage in the cylinder head between said recessed portions and an operating voltage conductor inset passage connecting said voltage control module and said plug-in connection.

6. The invention as set forth in claim 1 including a second internal passage in the cylinder head between the outside thereof and said one recessed portion and a line voltage conductor in said passage providing power at line voltage to said voltage control module.

7. In a pneumatic operator for a railroad track switch including a valve for directing compressed air from a source to the piston of a double acting pneumatic cylinder, the operator including a cylinder head providing a mounting surface for the valve and air flow porting between the valve and the cylinder, said porting including an inlet port, a first supply passage directing air to one side of the piston to stroke the piston in a first direction and receiving air from said one side of the piston when the piston is stroked in an opposite second direction, a second supply passage directing air to the other side of the piston to stroke the piston in the second direction and receiving air from said other side of the piston when the piston is stroked in the first direction, a first exhaust port receiving air from one side of the piston and a second exhaust port receiving air from the other side of the piston, the improvement in the cylinder head comprising:

an exhaust outlet connecting each of said outlet ports to the outside of the cylinder head; and, a common exhaust connection between said first and second exhaust ports, whereby exhaust air from either side of the piston will pass through both of said exhaust outlets.

8. In a pneumatic operator for a railroad track switch including an electric solenoid-operated valve for directing compressed air from a source to the piston of a double acting pneumatic cylinder, a cylinder head providing a mounting surface for the valve air flow porting between the valve and the cylinder, the improvement in the cylinder head comprising:

recessed portions in the cylinder head for receipt of electric power connections and components for operating the valve;

a voltage control module demountably received in one of the recessed portions in the cylinder head; and, the voltage control module including an electronic circuit device adapted to apply 12 volt operating power to the valve from line voltage in excess of about 14 volts and for passing line voltage between about 14 volts and a minimum operating voltage volts directly to the valve.

9. The improved cylinder head as set forth in claim 8 wherein the cylinder head includes a unitary main body, and further comprising:

line openings extending through an external wall in the body and into said one recessed portion;

line conductors extending through said openings and providing line voltage electric power to the voltage control module;

an internal line passage within the body between said one recessed portion and the valve mounting surface; and, internal conductors in said passage providing operating voltage electric power from the voltage control module to the valve.

10. The invention as set forth in claim 9 wherein said internal conductors include plug-in connectors at the valve mounting surface adapted for mating connection with complimentary connectors on the valve.

11. In a pneumatic operator for a railroad track switch including an electric solenoid-operated valve for directing compressed air from a source to the piston of a double acting pneumatic cylinder, a cylinder head providing a mounting surface for the valve, the improvement in the cylinder head comprising:

recessed portions for the mounting surface and for receipt of electric power connections for operating the valve;

a voltage control module demountably received in one of said recessed portions;

a first electric power connection delivering electric power at a line voltage to said voltage control module from outside the cylinder head;

a second electric power connection extending internally within the cylinder head from the voltage control module to the mounting surface on the cylinder head, said second connection including plug-in connectors at the mounting surface; and, a complimentary mounting surface on said valve, said complimentary mounting surface including mating connectors adapted to engage said plug-in connectors in response to connection of the valve to the cylinder head at the interface between the respective mounting surfaces.

* * * * *